US006567638B2

(12) United States Patent
Nakamura et al.

(10) Patent No.: US 6,567,638 B2
(45) Date of Patent: May 20, 2003

(54) METHOD AND APPARATUS FOR IMAGE FORMING CAPABLE OF EFFECTIVELY PERFORMING DEVELOPMENT

(75) Inventors: Makoto Nakamura, Kanagawa-ken (JP); Yoshiyuki Takano, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/987,008

(22) Filed: Nov. 13, 2001

(65) Prior Publication Data

US 2002/0085863 A1 Jul. 4, 2002

(30) Foreign Application Priority Data

Nov. 13, 2000 (JP) ..... 2000-345614
Dec. 11, 2000 (JP) ..... 2000-375882
Oct. 31, 2001 (JP) ..... 2001-333952

(51) Int. Cl.[7] ..... G03G 15/08
(52) U.S. Cl. ..... 399/286
(58) Field of Search ..... 118/653, 657, 118/658; 399/222, 265, 279, 286; 430/101, 110, 120, 124

(56) References Cited

U.S. PATENT DOCUMENTS 5,970,294 A 10/1999 Narita et al.
5,991,585 A 11/1999 Nakamura
6,070,038 A 5/2000 Imamura et al.
6,112,042 A 8/2000 Imamura et al.
6,287,246 B1 9/2001 Yoshii et al.
6,397,032 B1 * 5/2002 Sakaizawa et al. ..... 399/286

FOREIGN PATENT DOCUMENTS

JP 53-3233 1/1978

* cited by examiner

*Primary Examiner*—Hoang Ngo
(74) *Attorney, Agent, or Firm*—Oblon, Spivak, McClelland, Maier & Neustadt, P.C.

(57) ABSTRACT

A development roller includes a core shaft, an elastic layer coating the core shaft, and a surface layer coating the elastic layer. The surface layer has a resistance smaller than a resistance of the elastic layer. And, the development roller has an entire volume resistance smaller than a volume resistance of the elastic layer.

40 Claims, 10 Drawing Sheets

METHOD AND APPARATUS FOR IMAGE FORMING CAPABLE OF EFFECTIVELY PERFORMING DEVELOPMENT

BACKGROUND OF THE INVENTION

1. Field of the Invention

This patent specification relates to a method and apparatus for electrophotographic image forming, and more particularly to a method and apparatus for photographic image forming capable of effectively performing image development.

2. Discussion of the Related Art

In electrophotographic apparatuses such as copying machines, printers, facsimile machines, etc., and particularly small ones, machine maintenance is inevitable and therefore simplification of it is significantly important. For example, published Japanese unexamined patent application, No. 53-3233 (1978), describes a background development apparatus that develops an electrostatic latent image formed on a photosensitive member, a photosensitive sheet, a recording sheet, or the like, with a single-component toner. FIG. 15 illustrates a main portion of a background image forming apparatus using the above-mentioned background development apparatus.

As illustrated in FIG. 15, a photosensitive drum 101 includes a surface layer A and a base B. The surface layer A functions as an image carrying member and the base B functions as a supporting member for supporting the image carrying member. The base B includes a metal drum 102, a relatively-elastic conductive rubber 103 adhered on the surface of the metal drum 102, and a flexible metallic foil 104 (e.g., an aluminum foil) adhered on the rubber 103. The surface layer A includes a photoconductive insulating layer 105 formed by evaporation of a metal such as selenium onto the surface of the metallic foil 104.

A development roller 106 is held in contact with the photosensitive drum 101 under pressure. The development roller 106 includes a metal roller 107 and an elastic layer 108 formed on the surface of the metal roller 107; the elastic layer 108 is made of a conductive substance such as a synthetic rubber, a urethane foam, etc.

In the above-described development apparatus, an elasticizer or a high polymeric substance bleeding out from the above-mentioned elastic layer 108 of the development roller 106 may cause a problem of contaminating the surface layer A of the photosensitive drum 101 or generating a toner tacking or filming phenomenon on the surface of the elastic layer 108 of the development roller 106. For such a problem, a development roller is available in which the elastic layer 108 is coated with a surface layer (not shown) made of resin having a superior releasing property relative to the toner so that bleeding-out of the elasticizer and the high polymeric substance, as well as the generation of toner tacking and filming, can be avoided.

Further, in FIG. 15, a bias power 109 is connected between the development roller 106 and the base B of the photosensitive drum 101. Above the development roller 106, a hopper 111 containing a non-magnetic single-component toner 110 is held with a predetermined distance between a bottom opening of the hopper 111 and the surface of the development roller 106. A friction-charging member 112 is adhered to an inside surface of a right side wall of the hopper 111. A flattening member 113 is held on the right side of the development roller 106 in contact with the surface of the development roller 106 under pressure. The flattening member 113 includes a metal roller 114, a rubber layer 115 coating the surface of the metal roller 114, and a friction-charging member 116 coating the surface of the rubber layer 115. The flattening member 113 is held incapable of rotating.

With the above-described development roller 106, the toner can be carried thereon in a form of a thin layer. When the development roller 106 carrying the toner layer contacts the photosensitive drum 101 carrying an electrostatic latent image, the toner is transferred to the photosensitive drum 101 in accordance with a degree of an electric field for the development. Thereby, the electrostatic latent image formed on the photosensitive drum 101 is visualized with the toner. In using such a development roller 106, it is necessary to control a charge polarity and a charge amount relative to the toner with a friction charging through the contact between the toner and the development roller 106. Transfer of the toner to the photosensitive drum 101 is achieved by selections of an image region and a non-image region (a background region) in the electrostatic latent image. This background development apparatus illustrated in FIG. 15 advantageously facilitates an implementation of color image forming without the need of a non-magnet substance for the toner.

In the above-described background development apparatus, which develops an electrostatic latent image formed on the image carrying member with a single-component toner, a development system capable of performing the development at a relatively low development potential is needed. This is because there is a tendency to lower the charge potential in order to reduce an occurrence of a hazardous event during the charging time to achieve a long-life of a total image forming system including the development system, and particularly, of a photosensitive member. From a standpoint of achieving a high image quality, it becomes necessary to increase a development gamma as much as possible, which is a gradient of a curve representing a character of an image density relative to an electrostatic potential, and to make a development potential as small as possible for a saturation of the toner deposition to the photosensitive drum.

It is known to make a resistance of the development roller 106 smaller to raise the development gamma. When a resistance of the development roller is made small, it requires an application of a relatively high voltage such as −250 volts, for example, as a bias voltage, resulting in a problem of a current leakage to the image carrying member. Such leakage is prevented in the background development apparatus by an arrangement in that the resistance of the elastic layer 108 is made smaller than the resistance of the surface layer by adding a conductivity adding agent such as a carbon black to the elastic layer 108. However, when an excessive amount of the conductivity adding agent such as carbon black is added to the elastic layer, the hardness of the elastic layer is increased. This causes a problem of an inferior image quality since a nip is not sufficiently formed between the development roller 106 and the photosensitive drum 101. Also, it leads to another problem in that the elastic layer 108 is not easily formed in a roll shape.

SUMMARY OF THE INVENTION

This patent specification describes a novel development roller that addresses the above and other drawbacks in the background art. In one example, the novel development roller includes a core shaft, an elastic layer coating the core shaft, and a surface layer coating the elastic layer. The resistance of the surface layer is smaller than a resistance of the elastic layer, and an entire volume resistance of the development roller is smaller than a volume resistance of the elastic layer.

The volume resistance of the elastic layer may be $1.0\times10^9$ ohm·cm or less. The entire volume resistance of the development roller may be $1.0\times10^7$ ohm·cm or less. The resistance of the surface layer may be $1.0\times10^8$ ohms or less. The surface layer may have a thickness of 30 microns or less.

The patent specification further describes a novel development apparatus. In one example, the novel development apparatus includes a development roller that includes a core shaft, an elastic layer coating the core shaft, and a surface layer coating the elastic layer. The resistance of the surface layer can be smaller than a resistance of the elastic layer, and an entire volume resistance of the development roller can be smaller than a volume resistance of the elastic layer.

The patent specification further describes a novel image forming apparatus. In one example, the novel image forming apparatus includes a photosensitive member and a development mechanism including a development roller. The development roller includes a core shaft, an elastic layer coating the core shaft, and a surface layer coating the elastic layer. A resistance of the surface layer is smaller than a resistance of the elastic layer, and an entire volume resistance of the development roller is smaller than a volume resistance of the elastic layer.

The patent specification further describes a novel method of image forming. In one example, the novel method of image forming includes the steps of providing, supplying, regulating, and transferring. The providing step provides a rotary development roller that includes a core shaft coated with an elastic layer and a surface layer in this order, in parallel to a photosensitive member. The supplying step supplies toner onto a surface of the rotary development roller. The regulating step regulates the toner into a thin toner layer. The transferring step transfers the thin toner layer to the photosensitive member. A resistance of the surface layer is smaller than a resistance of the elastic layer, and an entire volume resistance of the development roller is smaller than a volume resistance of the elastic layer.

The volume resistance of the surface layer may be $1.0\times10^9$ ohm·cm or less. The entire volume resistance of the development roller may be $1.0\times10^7$ ohm·cm or less. The resistance of the surface layer may be $1.0\times10^8$ ohms or less. The surface layer may have a thickness of 30 microns or less. A toner deposition amount relative to a surface of the photosensitive member may be saturated when a development bias has a difference of 150 volts or less from a surface potential of an image region in the photosensitive member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
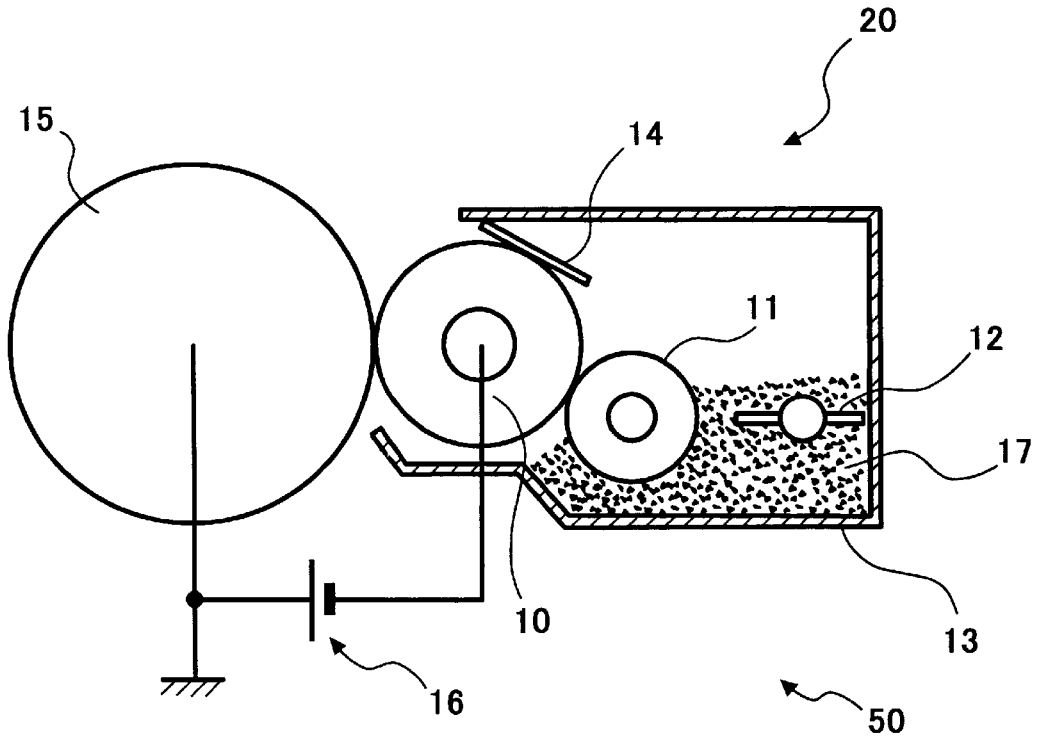
FIG. 1 is a schematic diagram for explaining a main portion of an image forming apparatus according to a preferred embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, and more particularly to FIG. 1 thereof, a main portion of an image forming apparatus 50 according to a preferred embodiment of the present invention is shown. As illustrated in FIG. 1, the image forming apparatus 50 includes a photosensitive member 15, a bias power supply unit 16, and a development mechanism 20. The development mechanism 20 includes a development roller 10, a toner supplying roller 11, a toner mixing member 12, a case 13, a toner layer regulating member 14, and toner 17. The toner supply roller 11 includes a sponge layer (not shown) wrapped around a core shaft (not shown) thereof. The development roller 10, the toner supply roller 11, and the toner mixing member 12 are held by the case 13.

The toner 17 contained in the development mechanism 20 is transferred and deposited to the surface of the development roller 10 via the toner mixing member 12 and the toner supplying roller 11. The toner 17 deposited on the surface of the development roller 10 is regulated into a thin layer having a predetermined thickness by the toner regulating member 14 and is transferred to the photosensitive member 15 by the rotating development roller 10.

The development roller 10 contacts the photosensitive member 15. A bias voltage is applied by the bias power supply unit 16. The bias voltage is adjusted, via electrodes, to an intermediate value between values of a charge potential and a residual potential after an exposure process on the photosensitive member 15. This bias is referred to as a development bias. When the charged toner 17 on the development roller 10 is transferred by the development roller 10 to a region where the development roller 10 contacts the photosensitive member 15, the toner 17 is attracted to the surface of the photosensitive member 15 in accordance with a development electric field generated by the charge potential of the photosensitive member 15 and the development bias, thereby forming an electrostatic latent image.

Figure 2:
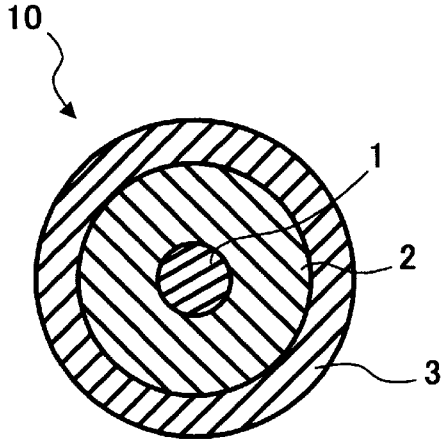
FIG. 2 is a cross-sectional view of a development roller included in the image forming apparatus of FIG. 1.
Figure 3:
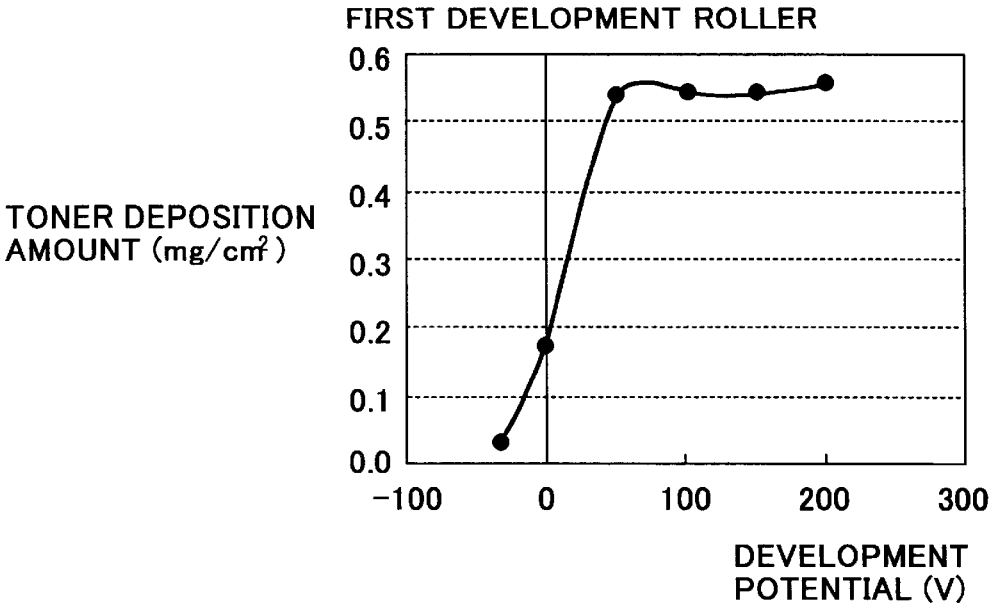
FIGS. 3–7 are graphs representing relationships between a toner deposition amount and a development potential in five different examples of the development roller of FIG. 2.
Figure 4:
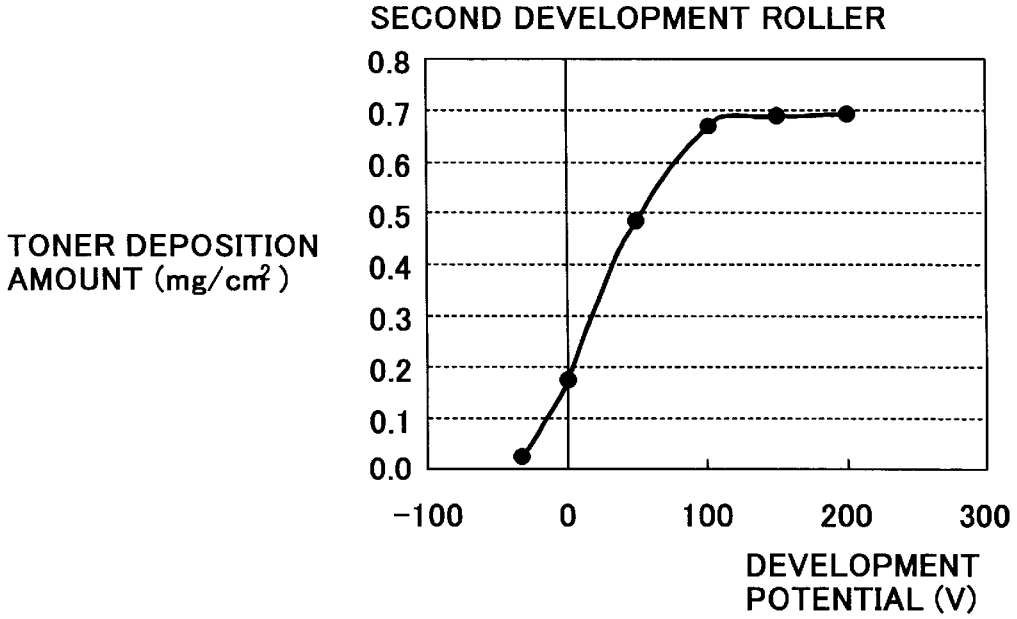
Figure 5:
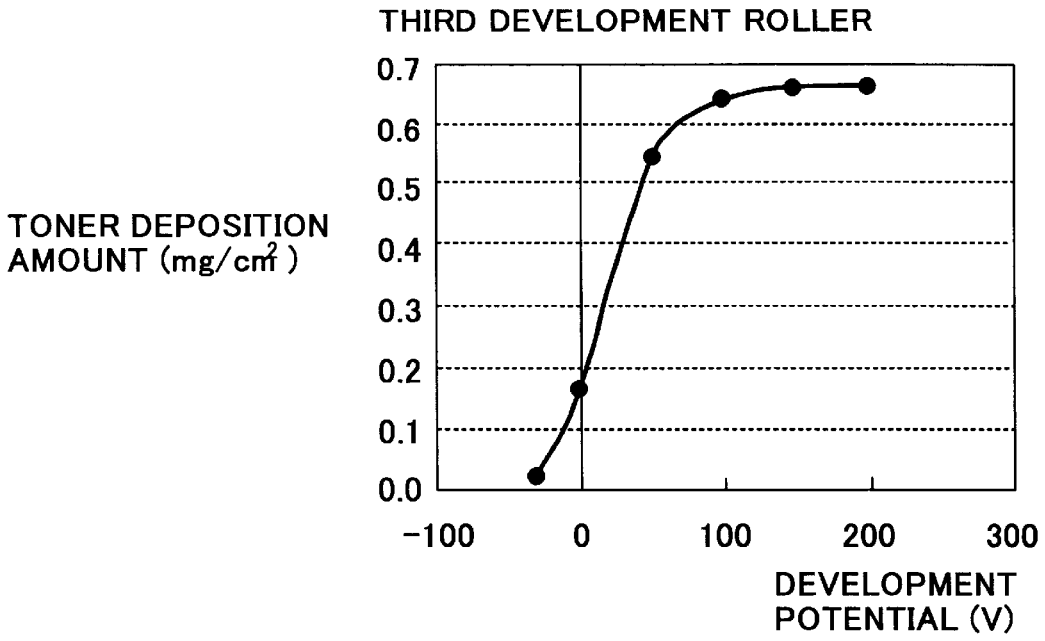
Figure 6:
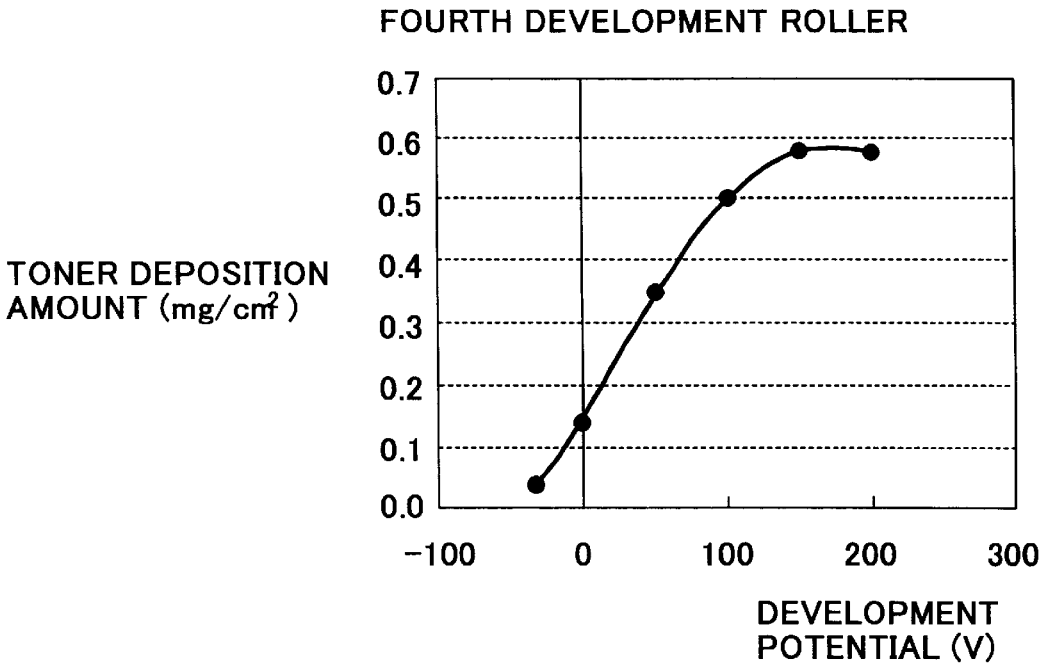
Figure 7:
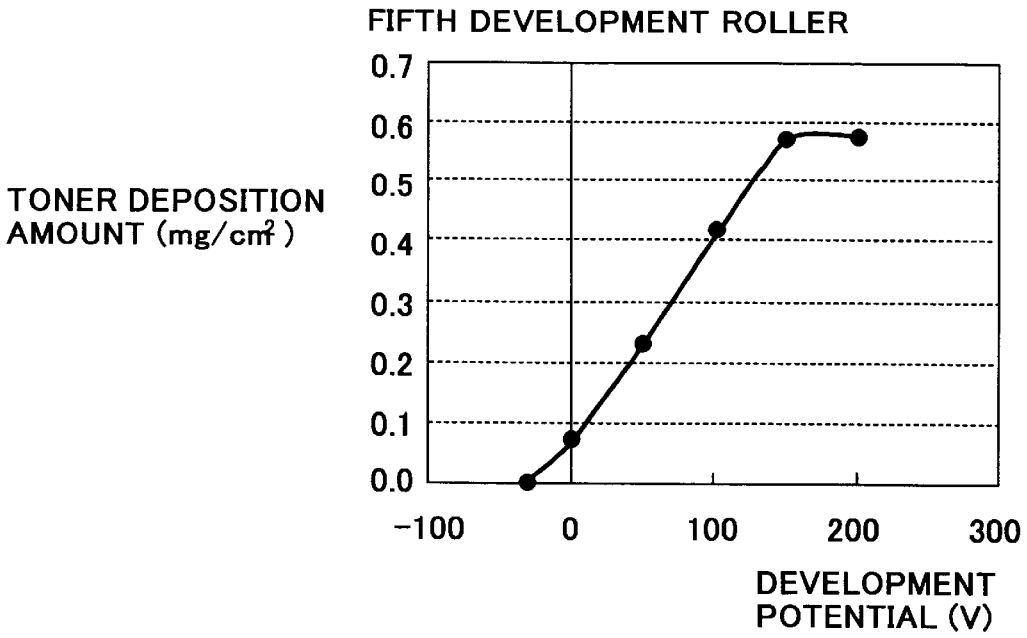
Figure 8:
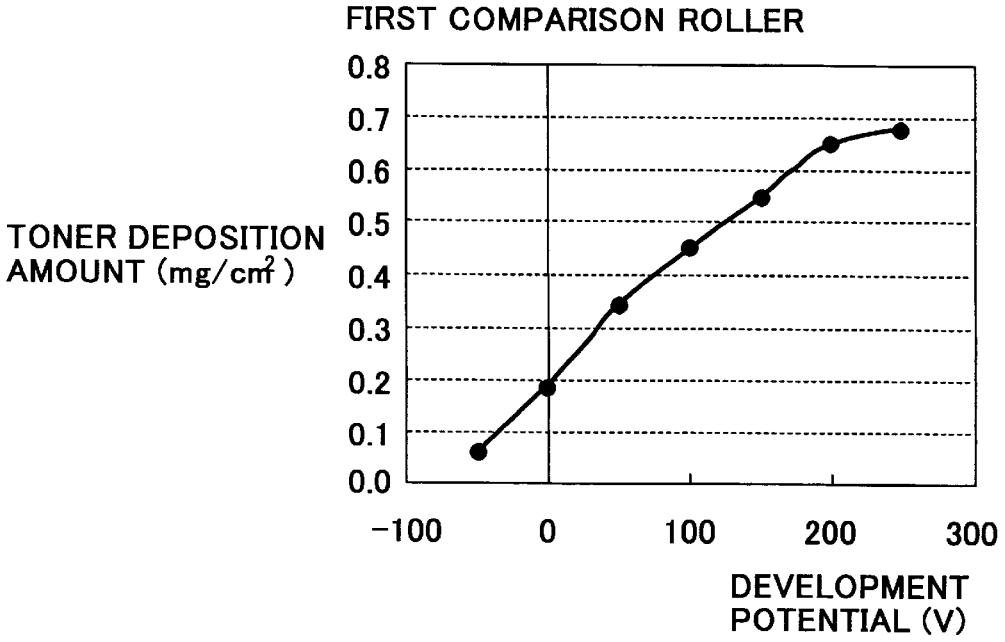
FIGS. 8–11 are graphs representing relationships between a toner deposition amount and a development potential in four different examples of comparison rollers based on the development roller of FIG. 2.
Figure 9:
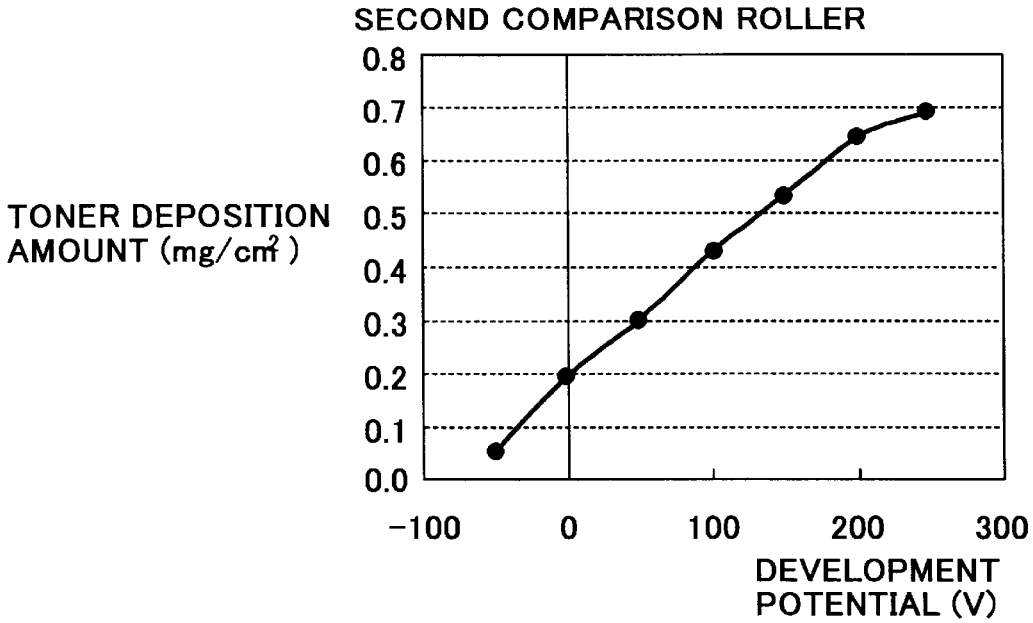
Figure 10:
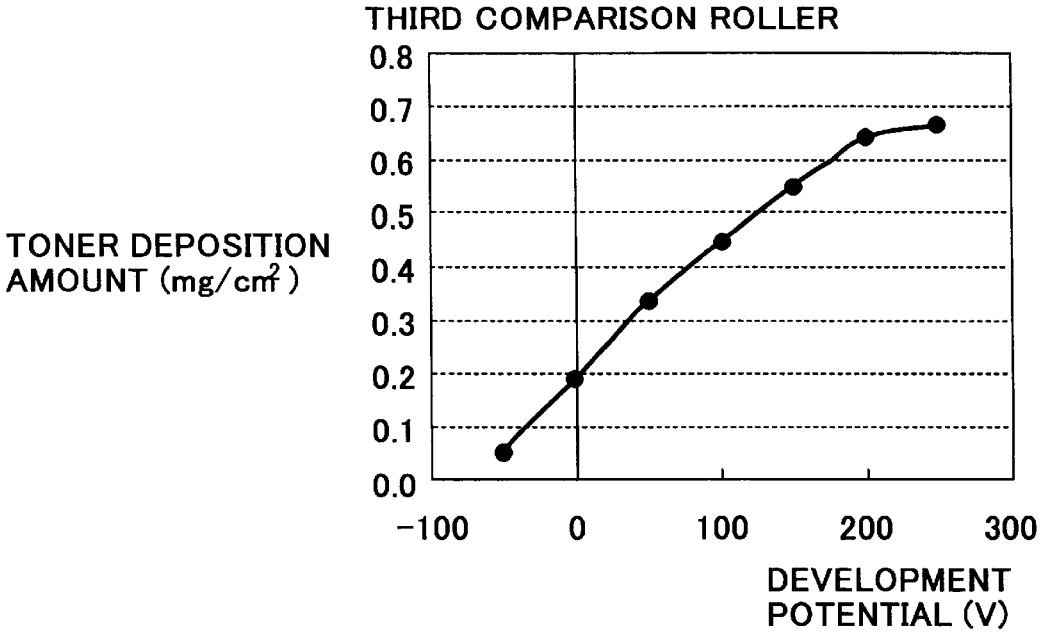
Figure 11:
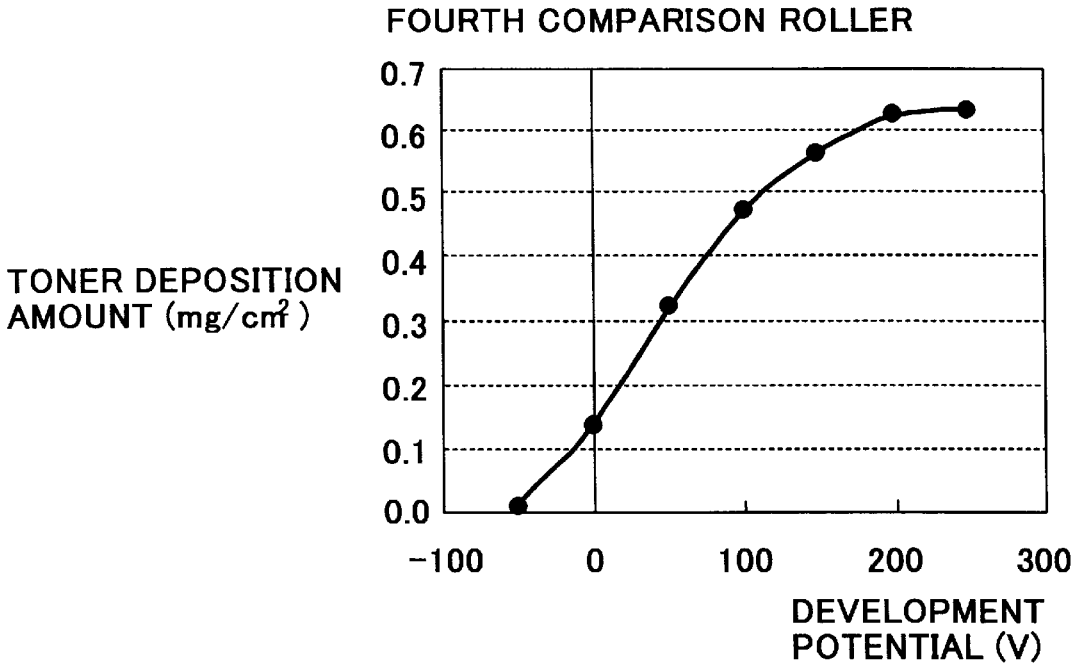

FIG. 2 illustrates a cross-sectional view of the development roller 10 that includes a core shaft 1, an elastic layer 2, and a surface layer 3. The core shaft 1 is made of metal and is wrapped by the elastic layer 2 that is made of rubber or elastomer. A preferred resin or rubber material for the elastic layer 2 may be any one of, for example, polyurethane, ethylenepropylenedienemethylene (EPDM), natural rubber, caoutchouc, butyl-rubber, Butylrubber, nitrile rubber, NBR, epichlorohydrin rubber, polyisoprene rubber, polybutadiene rubber, silicone rubber, styrene-butadiene rubber, ethylene-propylene rubber, chloroprene rubber, acrylic rubber, and a mixture of these materials. Materials other than those described above may of course be used unless they impair the performance of the presently preferred embodiment.

A mixture of a cross-linker, a curing agent, etc. may be added to the above-mentioned resin and rubber materials so that these resins and rubbers are elasticized by linkage of molecules. Whenever an organic peroxide linkage or a sulfur linkage is conducted with one of the above-mentioned mixture, the mixture may be the one including a curing auxiliary agent, a curing accelerator, a curing retardant, and the like. Other mixtures of general rubber compounds including a blowing agent, a plasticizer, a softener, an adhesion adding agent, an adhesion inhibiting agent, a separating agent, a mold releasing agent, a filler, a colorant, and the like, may successfully be added to the above-mentioned resin and rubber materials within a safe range that does not impair the properties of the elastic layer 2.

Generally, the elastic layer 2 is not limited in hardness. But, in a structure in which the development roller 10 contacts the photosensitive member 15, the hardness of the elastic layer 2 should be smaller than 60 degrees, more preferably between 25 degrees and 50 degrees, according to the scale A of JIS (Japanese Industrial Standard). When the elastic layer 2 has an excessively high hardness, the development roller 10 may contact the photosensitive member 15 with a relatively narrow nip formed therebetween. As a result, the development process may be not conducted in a preferable manner, particularly when the photosensitive member 15 has a drum shape. On the other hand, when the elastic layer 2 has an excessively low hardness, the elastic layer 2 may be subjected to a permanent deformation due to a contact pressure from the photosensitive member 15. In this case, a problem of uneven density may typically be caused when the development roller 10 undergoes a mechanical distortion or an eccentric movement. Moreover, in a lower region of the hardness, the above-mentioned tendency largely depends on properties inherent in materials, and therefore limited kinds of materials are usable for the elastic layer 2. When it is intended to provide the elastic layer 2 with a relatively low hardness, the permanent deformation due to a contact pressure from the photosensitive member 15 is preferably made as small as possible, and more specifically smaller than 20%.

The surface layer 3 covers the outer surface of the elastic layer 2. Generally, a kind of resin material constituting the surface layer 3 is not limited, provided the resin material does not contaminate the toner as well as the photosensitive member 15 that carries an electrostatic latent image on the surface thereof. However, the material of the surface layer 3 needs to have properties to at least be flexible and wear resistant since this material is coated on the surface of the elastic layer 2. Accordingly, the surface layer 3 can be made of any one of the resin materials such as a urethane resin, a polyester resin, a silicone resin, a fluoride resin, and a copolymer made of fluoro-olefin and an ethylene unsaturated monomer such as vinyl ethers, allyl ethers, vinyl esters, and the like. Also, resin materials other than those described above may be utilized unless they impair the performance of the presently preferred embodiment. The above-mentioned resin materials may have an additive similar to one added to the resin materials forming the elastic layer 2. It is also possible to use a curing agent to increase toner and wear resistances of the surface layer 3.

Preferably, the surface layer 3 is provided with a thickness of 30 microns or less. When the surface layer 3 has a thickness exceeding 30 microns, it may become harder than the elastic layer 2. As a result, the surface layer 3 becomes apt to splinter and to generate wrinkles. This leads to a problematic phenomenon in that, for example, the surface layer 3 may decrease its creep characteristic, that is, a recovery from a possible creep is delayed. Therefore, according to the preferred embodiment, the surface layer 3 is configured to have a thickness of 30 microns or less so that the surface layer 3 is capable of avoiding impairment of hardness of the elastic layer 2 as well as preventing wrinkle generation. The surface layer 3 may be coated over the elastic layer 2 through a known coating technique such as a dip method, a spray coat, a roll coat, etc.

One important feature of the development roller 10 according to the preferred embodiment is an electric characteristic. A resistance of the surface layer 3 is made smaller than that of the elastic layer 2 so that a volume resistance of the whole development roller 10 is made smaller than that of the elastic layer 2. Here, the volume resistance is defined as a volume resistance having a unit of ohm·cm and that is obtained when the development roller 10 with an application of 1 volt is measured in a circumferential direction.

Since the development roller 10 is arranged to have a volume resistance smaller than that of the elastic layer 2 by making the resistance of the surface layer 3 smaller than that of the elastic layer 2, as described above, the whole development roller 10 is capable of acting as an electrode. Accordingly, a large part of a current flows through the elastic layer 2 and the surface layer 3. The volume resistance of the development roller 10 is rendered smaller than that of the elastic layer 2 by itself, as a result. Therefore, it becomes possible to provide to the development roller 10 a relatively low hardness and a relatively low resistance and to prevent a current leakage to an electrostatic latent image with a side effect of expansion of selectable materials for the elastic layer 2, by making the resistance of the surface layer 3 smaller than that of the elastic layer 2 so that the development roller 10 has a volume resistance smaller than that of the elastic layer 2, as arranged according to the presently preferred embodiment.

In this preferred embodiment, the resin and rubber materials forming the elastic layer 2 and the surface layer 3 may include various kinds of additives for providing conductivity. The resistances of the elastic layer 2 and the surface layer 3 are decreased with an increase of an amount of the conductive additives. The conductive additives may include any one of conductive carbon powders including a ketjen-black EC, an acetyleneblack, etc., a carbon for rubber such as SAF, ISAF, HAF, FEF, GPF, SRF, FT, MT, etc., a carbon for color undergone oxidization, a thermolysis carbon, or any one of metals including indium tin oxide (ITO), stannic oxide, titanium oxide, zinc oxide, copper, silver, germanium, etc., or any one of conductive polymers including metal oxide, polyanilin, polypyrrol, polyacetylene, etc. Alternatively, ionic conductive substances may be used for the conductive additives. For example, the ionic conductive substances include inorganic ionic conductive substances including perchloric acid sodium, perchloric acid lithium, perchloric acid calcium, lithium chloride, etc., and organic ionic substances including denatured fatty acid diethylanmoniumethosulfate, stearic acid anmoniumacetate, laurylanmoniumacetate, octadecyltrymethylanmonium perchloric acid chloride, etc.

In the present preferred embodiment, the volume resistance value of the elastic layer 2 is preferably $1.0\times10^9$ ohm·cm or less, and more preferably in a range of from $10^3$ ohm·cm to $10^9$ ohm·cm. A material may become an extremely-difficult-to-machine material and its hardness will be increased as well when the volume resistance value of the material is less than $10^3$ ohm·cm. On the other hand, it becomes difficult to arrange the volume resistance of the development roller 10 coated with the surface layer 3, as a whole, to a preferable value (i.e., $1.0\times10^7$ ohm·cm or less) when the volume resistance value of the material of the elastic layer 2 exceeds $10^9$ ohm·cm.

In the present preferred embodiment, the volume resistance of the whole development roller 10 is configured to be $1.0\times10^7$ ohm·cm or less, and therefore an amount of toner deposited on the surface of the photosensitive member 15 can be saturated with a development potential of 150 volts or less, which is far less than that of the background development system. By rendering the volume resistance of the whole development roller 10 smaller, the development bias can also be reduced, that is the charge potential of the photosensitive member 15 can be made smaller (e.g. 300 volts). As a result, the potential of an image region is several tens of volts. For example, when the potential of a background region is 100 volts, the development bias is consequently lower than 200 volts.

A substantial resistance of the surface layer 3 according to the presently preferred embodiment is preferably $1.0\times10^8$ ohms or less. By making it $1.0\times10^8$ ohms or less, an amount of the toner deposited on the surface of the photosensitive member 15 can be saturated with a development potential of 150 volts or less, which is far less than that of the background development system.

The development mechanism 20 according to the presently preferred embodiment is configured such that an amount of the toner deposited on the surface of the photosensitive member 15 is saturated under conditions that a difference between a surface potential of an image region on the photosensitive member 15 and a development potential is 150 volts or less. With this configuration, it becomes possible to prevent the development mechanism 20 from causing a current leakage to the photosensitive member 15, regardless of the low volume resistance of the development roller 10. Also, it becomes possible to achieve the binary-valued development with an application of a relatively low potential. Further, it becomes possible to prolong the life of the photosensitive member 15 since the charge potential of the photosensitive member 15 can be reduced.

The toner 17 used in the presently preferred embodiment includes resin powder made of a resin such as, for example, polyester, polyol, a styrene resin, acrylic, etc. mixed with a charge control agent (CCA) and a colorant. To increase fluidity of the toner, an additive including silica, titanium oxide, etc. is added around the resin powder. This additive generally has a particle diameter in a range from 0.1 microns to 1.5 microns. For the colorant, any one of a carbon black, a phthalocyanine blue, Quinacridone, carmine, etc. can be used. The toner 17 has a negative-charge character, that is the toner 17 is negatively charged during the development process. The toner 17 may include base toner particles made of the toner dispersively mixed with wax or the like and to which the above-mentioned additive is added. The toner 17 preferably has a volume mean particle diameter in a range of from 3 microns to 12 microns. An actual value of the volume mean particle diameter in one preferred embodiment was found to be 7 microns. Thereby, the toner 17 of the presently preferred embodiment sufficiently suits an image with a relatively high resolution over 1200 dpi.

The toner layer regulating member 14 may be made of a metal such as stainless, bronze phosphate, etc. or of an elastic substance such as an urethane rubber, a silicone rubber, etc. It is possible to add various kinds of coating materials to the toner layer regulating member 14 at a region contacting the development roller 10.

Next, descriptions are made to five exemplary development rollers that were experimentally produced on the basis of the above-described development roller 10. A first development roller was provided with an 8-mm-diameter SUS (stainless steel) core shaft previously coated with an adhesive agent. This SUS core shaft was coated with a resin material, including polyol and isocyanate dispersed with a carbon black of 5 weight-percentage, using a one-shot method and a urethane elastomer layer formed on the surface of the SUS core shaft. This urethane elastomer layer was ground so that an outside diameter thereof was adjusted to 16 mm. As a result, a roller having a SUS core shaft coated with a 4-mm-thick elastic layer was made. In the meantime, a fluororesin coating fluid was made by dissolving a fluororesin (i.e., THV220P manufactured by Sumitomo 3M Ltd.) with MEK (methyl ethyl ketone) and then dispersing a carbon black of 20 weight-percentage (relative to the fluororesin) into the fluororesin solution. Finally, the fluororesin solution was sprayed on the elastic layer of the roller to form a 20-micron surface layer thereon. The first development roller was made in this way.

A second development roller was provided with an 8-mm SUS core shaft and an elastic layer in a manner similar to the first development roller. After that, a conductive urethane coating (i.e., Supalex manufactured by Nihon Miracleton Co., Ltd.) dissolved with MEK (methyl ethyl ketone) was sprayed on the elastic layer to form thereon a surface layer of 20 microns. Thus, the second development roller was made.

A third development roller was also provided with an 8-mm SUS core shaft in a manner similar to the first development roller. In this case, an epichlorohydrin rubber material was prepared based on an epichlorohydrin rubber added with a calcium carbide, sulfur, a curing accelerator, etc. The 8-mm SUS core shaft was coated with the epichlorohydrin rubber material by extrusion and an epichlorohydrin rubber layer was formed on the core shaft. The epichlorohydrin rubber layer was ground to a diameter of 16 mm. Thereby, a roller having the 8-mm SUS core shaft coated with the 4-mm-thick elastic layer was prepared. After that, as in the case with the first development roller, the fluororesin coating fluid was sprayed to form a 20-micron thick surface layer on the elastic layer of the roller. Thus, the third development roller was made.

A fourth development roller was provided with an 8-mm SUS core shaft having an elastic layer in a manner similar to the first development roller. In this case, a fluororesin solution prepared based on a fluororesin (i.e., Lumiflon manufactured by Asahi Glass Co., Ltd.), a copolymer made of fluoro-olefin and an ethylene unsaturated monomer, was dissolved with a solution made of toluene and xylene. Then, a metal oxide substance (i.e., ITO; indium tin oxide) of 66 weight-percentage (relative to the fluororesin) and a curing agent of 20 weight-percentage (relative to the fluororesin) was dispersed into the fluororesin solution, thereby making a fluororesin coating fluid. The fluororesin coating fluid was sprayed on the elastic layer of the roller, and was heated to be hardened to form a 20-micron thick surface layer on the elastic layer of the roller. Thus, the fourth development roller was made.

A fifth development roller was provided with an 8-mm SUS core shaft having an elastic layer in a manner similar to the third development roller. After that, a surface layer was provided to the surface of the elastic layer in a manner similar to the fourth development roller. Thus, the fifth development roller was made.

Next, descriptions are made to an additional four exemplary development rollers that were experimentally produced on the basis of the above-described development roller 10 for the purpose of comparing performances with the above-described five development rollers. These four development rollers are referred to as comparison rollers.

A first comparison roller was provided with an 8-mm SUS core shaft with an elastic layer in a manner similar to the first development roller. Then, a fluororesin coating fluid was made by dissolving a fluororesin (i.e., THV220P manufactured by Sumitomo 3M Ltd.) with MEK (methyl ethyl ketone) and then dispersing a carbon black of 3 weight-percentage (relative to the fluororesin) into the fluororesin solution. Finally, the fluororesin solution was sprayed on the elastic layer of the roller to form a 20-micron surface layer thereon. The first comparison roller was made in this way.

A second comparison roller was provided with an 8-mm SUS core shaft having an elastic layer in a manner similar to the third development roller. Then, a surface layer was provided on the elastic layer in a manner similar to the third development roller. Thus, the second comparison roller was made.

A third comparison roller was provided with an 8-mm SUS core shaft having an elastic layer in a manner similar to the first development roller. In this case, a fluororesin solution prepared based on a fluororesin (i.e., Lumiflon manufactured by Asahi Glass Co., Ltd.), a copolymer made of fluoro-olefin, and an ethylene unsaturated monomer, was dissolved with a solution made of toluene and xylene. Then, a metal oxide substance (i.e., ITO; indium tin oxide) of 58 weight-percentage (relative to the fluororesin) and a curing agent of 20 weight-percentage (relative to the fluororesin) was dispersed into the fluororesin solution, thereby making a fluororesin coating fluid. The fluororesin coating fluid was sprayed on the elastic layer of the roller, and was heated to be hardened to form a 20-micron thick surface layer on the elastic layer of the roller. Thus, the third comparison roller was made.

A fourth comparison roller was provided with an 8-mm-diameter SUS (stainless steel) core shaft previously coated with an adhesive agent. This SUS core shaft was coated with a resin material, including polyol and isocyanate that were dispersed with a carbon black of 2 weight-percentage, using a one-shot method and a urethane elastomer layer formed on the surface of the SUS core shaft. This urethane elastomer layer was ground so that an outside diameter thereof was adjusted to 16 mm. As a result, a roller having a SUS core shaft coated with a 4-mm-thick elastic layer was made. Then, a surface layer was created onto the elastic layer of the roller in a manner similar to the third comparison roller. Thus, the fourth comparison roller was made.

Each of the five development rollers and the comparison rollers were tested with the development mechanism 20 of the image forming apparatus 50 and, through the tests, a development potential (V) and an amount of the toner ($mg/cm^2$) deposited to the surface of the photosensitive member 15 were measured. Based on the measured data, an analysis was made on a relationship between the development potential and the toner deposition amount. FIGS. 3–7 illustrate relationships between the development potential and the toner deposition amount in the cases of the first, second, third, fourth, and fifth development rollers, respectively. FIGS. 8–11 illustrate relationships between the development potential and the toner deposition amount in the cases of the first, second, third, and fourth comparison rollers, respectively.

Also, the volume resistance (ohm·cm) and the hardness (degree) according to the scale A of JIS were measured in each case of the first through to fifth development rollers and the first through to fourth comparison rollers. In each case, the surface resistance (ohm), the whole volume resistance (ohm·cm), which is a total volume resistance for the elastic and surface layers, and the saturated development potential were further measured. The measurement results are shown in Table 1 below.

TABLE 1

| A | B | C | D | E | F | G |
|---|---|---|---|---|---|---|
| 1 | E>S | 32 | $6.1 \times 10^6$ | $1.1 \times 10^3$ | $3.6 \times 10^2$ | 50 |
| 2 | E>S | 32 | $6.1 \times 10^6$ | $2.2 \times 10^3$ | $3.2 \times 10^2$ | 50 |
| 3 | E>S | 47 | $1.7 \times 10^8$ | $1.4 \times 10^3$ | $1.0 \times 10^3$ | 100 |
| 4 | E>S | 32 | $6.1 \times 10^6$ | $1.1 \times 10^5$ | $1.3 \times 10^4$ | 150 |
| 5 | E>S | 47 | $1.7 \times 10^8$ | $7.6 \times 10^7$ | $2.8 \times 10^6$ | 150 |
| 6 | E<S | 32 | $6.1 \times 10^6$ | $1.3 \times 10^8$ | $8.6 \times 10^8$ | 200< |
| 7 | E>S | 47 | $1.7 \times 10^8$ | $1.1 \times 10^9$ | $6.0 \times 10^9$ | 200< |
| 8 | E<S | 32 | $6.1 \times 10^6$ | $6.2 \times 10^8$ | $7.9 \times 10^8$ | 200< |
| 9 | E>S | 30 | $2.6 \times 10^{10}$ | $4.5 \times 10^8$ | $3.3 \times 10^7$ | 200 |

In this Table, numbers 1–5 in column A correspond to the first through to fifth development rollers, respectively, and numbers 6–9 correspond to the first through to fourth comparison rollers, respectively. Column B represents a comparison result in each case of the roller, indicating whether the resistance of the elastic layer represented by the letter E is greater or smaller than that of the surface layer represented by the letter S. For example, in the case of the first development roller, the resistance of the elastic layer (E) is greater than the resistance of the surface layer (S). Column C represents a value of the hardness according to the scale A of JIS. For example, the elastic layer of the first development roller has the hardness of 32 degrees. Column D represents a value of the volume resistance (ohm·cm) of the elastic layer. Column E represents a value of the resistance (ohm) of the surface layer. Column F represents a value of the total volume resistance (ohm·cm) of the elastic and surface layers. Column G represents a value of the saturated development potential (V).

Figure 12:
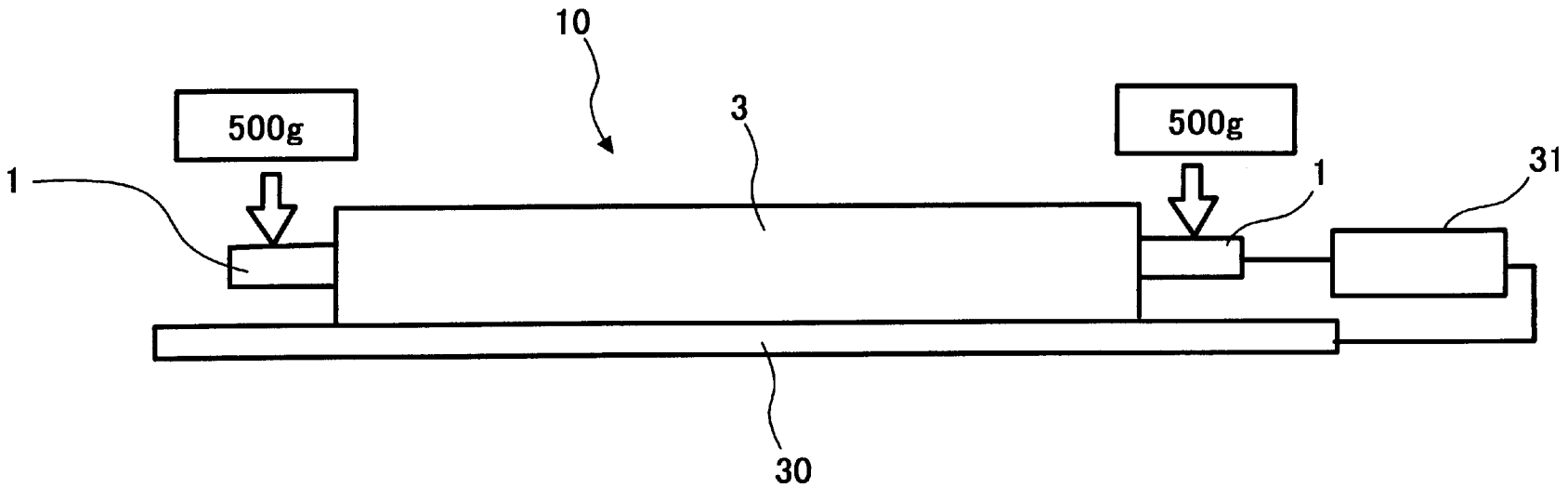
FIG. 12 is an illustration for explaining a way of measuring a volume resistance of the development roller of FIG. 2.

It should be noted that the volume resistance (ohm·cm) was measured with a resistance meter, R8340A, produced by Advantest Co., Ltd., Japan. FIG. 12 demonstrates a way of measuring the volume resistance of the development roller with such a resistance meter. As illustrated in FIG. 12, the development roller 10 was evenly pressed against a plane table electrode 30 with a load of 500 g to each end of the core shaft 1 in a direction toward the plane table electrode 30. A resistance meter 31 was connected between the core shaft 1 and the plane table electrode 30. Under this condition, a voltage of 1 volt was applied between the core shaft 1 and the plane table electrode 30 for 30 seconds and a value on the resistance meter 31 was read.

Figure 13:
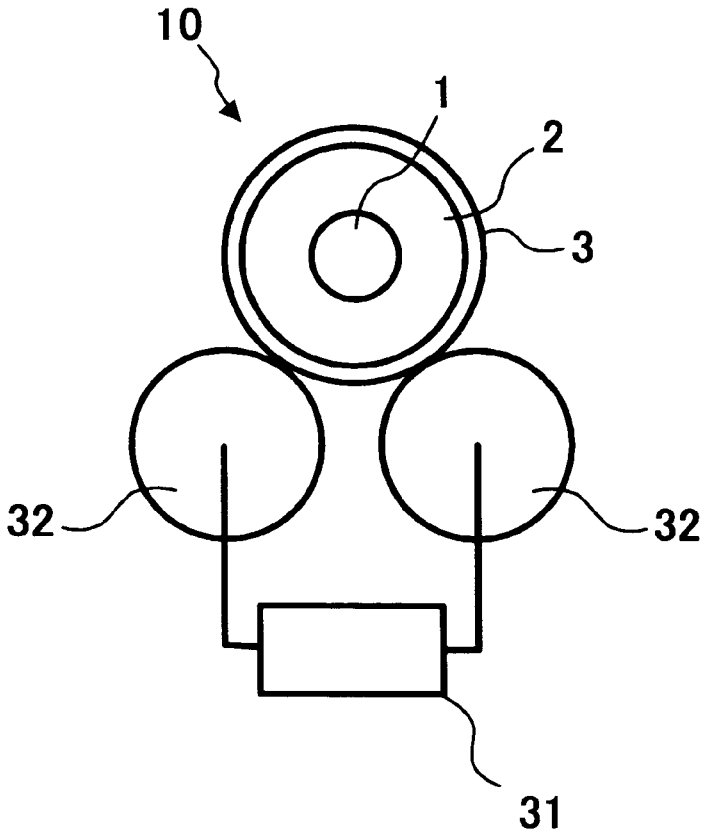
FIG. 13 is an illustration for explaining a way of measuring a resistance of a surface layer of the development roller of FIG. 2.

The surface resistance (ohm) was also measured with the resistance meter, R8340A, produced by Advantest Co., Ltd., Japan. FIG. 13 demonstrates a way of measuring the resistance of the surface layer of the development roller. As illustrated in FIG. 13, the development roller 10 was evenly pressed against two roll electrodes 32. The resistance meter was connected between the two roll electrodes 32. Under this condition, a voltage of 1 volt was applied between the core shaft 1 and the roll electrodes 32 for 30 seconds and a value on the resistance meter was read.

It should be noted that the saturated development potential shown in Table 1 represents a development potential at which the amount of toner deposition to the photosensitive member 15 is saturated, and was found from the graphs of FIGS. 3–11.

As evident from Table 1, in the first through fifth development rollers improvement in the saturated development potential was realized in comparison to that in the first to fourth comparison rollers.

Figure 14:
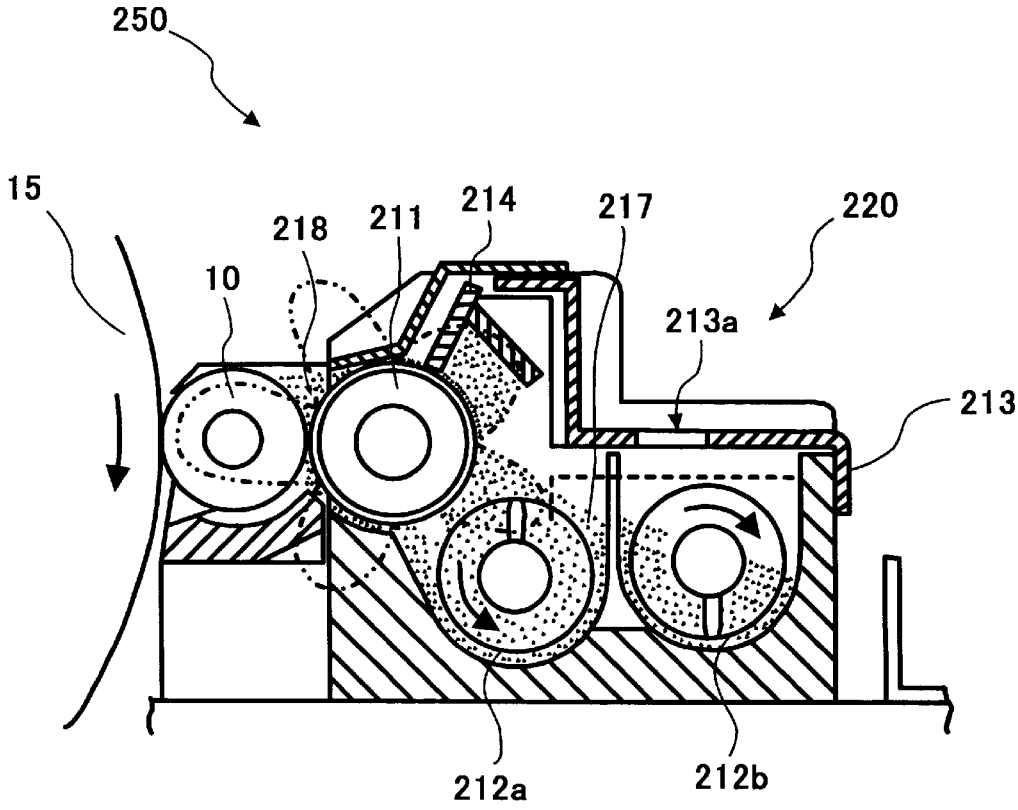
FIG. 14 is a schematic diagram for explaining a main portion of another image forming apparatus according to a preferred embodiment of the present invention.
Figure 15:
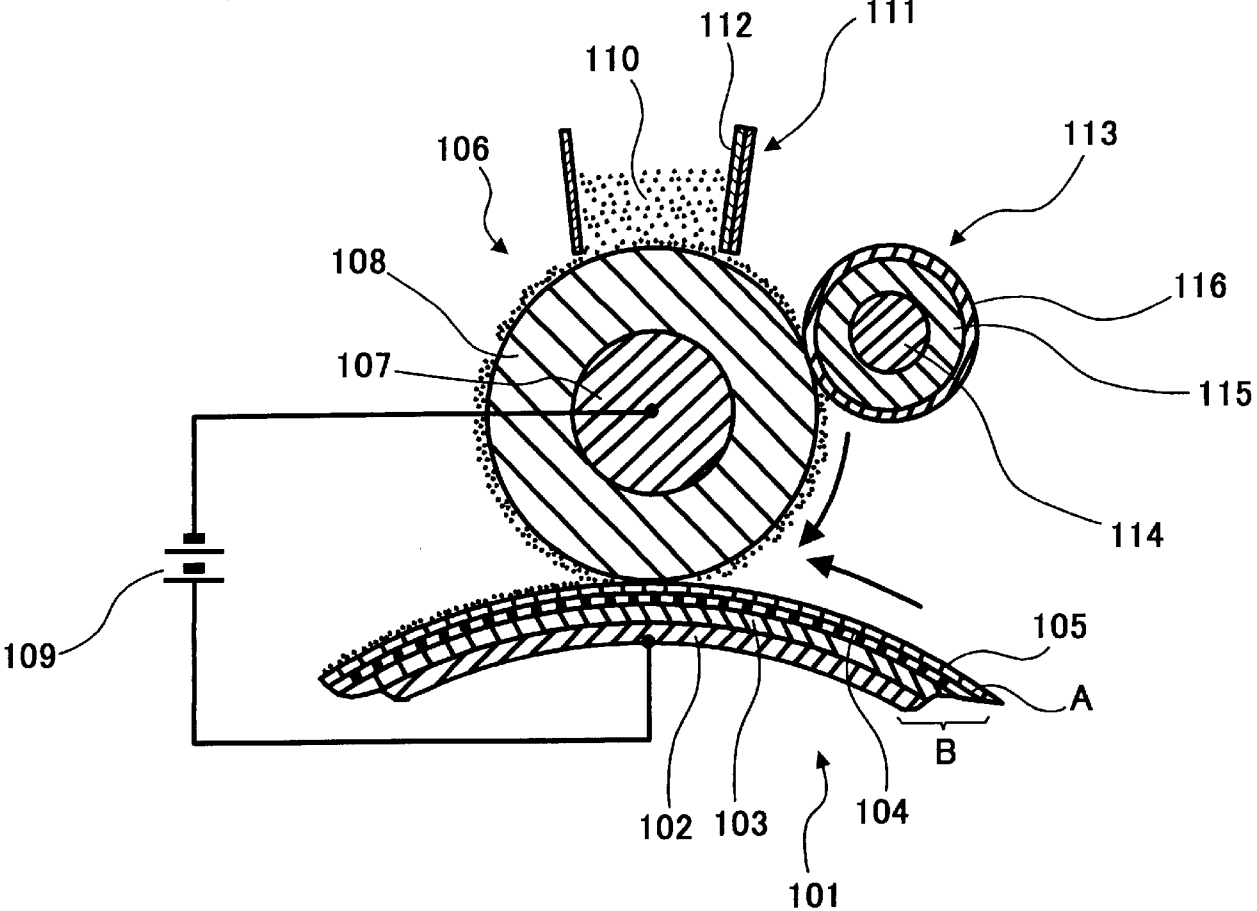
FIG. 15 BACKGROUND ART
FIG. 15 is a schematic diagram for explaining a main portion of a background image forming apparatus.

Next, another exemplary image forming apparatus 250 according to the preferred embodiment is explained with reference to FIG. 14. FIG. 14 illustrates a main portion of the image forming apparatus 250, which is similar to the image forming apparatus of FIG. 1, except for a development mechanism 220. The development mechanism 220 includes the development roller 10, a toner supply magnet roller 211, toner mixing rollers 212*a* and 212*b*, a casing 213, a toner replenishing hole 213*a*, a doctor blade 214, and a thin layer forming region 218. Reference numeral 217 denotes a two-component development agent including toner and carriers.

In the development mechanism 20 of the image forming apparatus 250, the development roller 10 rotating in a direction, as illustrated in FIG. 13, is held in parallel to and in contact with the photosensitive member 15 and the toner supply magnet roller 211 is arranged at a position facing the development roller 10. The doctor blade 214 is mounted on the toner supply magnet roller 211.

The two-component development agent 217 is replenished through the toner replenishing hole 213*a* and is mixed by the toner mixing rollers 212*a* and 212*b* rotating in the directions illustrated by the arrows in FIG. 13. Then, the two-component development agent 217 is raised to the toner supply magnet roller 211 and is regulated into a thin layer by the doctor blade 214. When the two-component development agent 217 is regulated into a thin layer, a magnet brush having a mixture of toner and carriers is formed. The thus-formed magnet brush is moved forward by the rotation of the toner supply magnet roller 211 in a clockwise direction in FIG. 14 and contacts the development roller 10 in the thin layer forming region. When in contact, the development roller 10 selectively receives the toner from the magnet brush. Thereby, the toner is transferred to the development roller 10.

Numerous additional modifications and variations of the present invention are possible in light of the above teachings. It is therefore to be understood that within the scope of the appended claims, the disclosure of this patent specification may be practiced otherwise than as specifically described herein.

This application is based on Japanese patent applications, No. JPAP2000-345614 filed on Nov. 13, 2000, and No. JPAP2000-375882 filed on Dec. 11, 2000, in the Japanese Patent Office, the entire contents of which are hereby incorporated herein by reference.

What is claimed is:

1. A development roller, comprising:

a core shaft;

an elastic layer coating said core shaft; and a surface layer coating said elastic layer, wherein a resistance of said surface layer is smaller than a resistance of said elastic layer, and wherein an entire volume resistance of said development roller is smaller than a volume resistance of said elastic layer and is smaller than the resistance of said surface layer.

2. A development roller as defined in claim 1, wherein said volume resistance of said elastic layer is $1.0\times10^9$ ohm·cm or less.

3. A development roller as defined in claim 1, wherein said entire volume resistance of said development roller is $1.0\times10^7$ ohm·cm or less.

4. A development roller as defined in claim 3, wherein said resistance of said surface layer is $1.0\times10^8$ ohms or less.

5. A development roller as defined in claim 1, wherein said surface layer has a thickness of 30 microns or less.

6. A development roller, comprising:

a core shaft;

first coating means for coating said core shaft; and second coating means for coating said first coating means, wherein a resistance of said second coating means is smaller than a resistance of said first coating means, and wherein an entire volume resistance of said development roller is smaller than a volume resistance of said first coating means and is smaller than the resistance of said second coating means.

7. A development roller as defined in claim 6, wherein said volume resistance of said first coating means is $1.0\times10^9$ ohm·cm or less.

8. A development roller as defined in claim 6, wherein said entire volume resistance of said development roller is $1.0\times10^7$ ohm·cm or less.

9. A development roller as defined in claim 8, wherein said resistance of said second coating means is $1.0\times10^8$ ohms or less.

10. A development roller as defined in claim 6, wherein said second coating means has a thickness of 30 microns or less.

11. A development apparatus, comprising:

a development roller comprising:

a core shaft;

an elastic layer coating said core shaft; and a surface layer coating said elastic layer, wherein a resistance of said surface layer is smaller than a resistance of said elastic layer, and wherein an entire volume resistance of said development roller is smaller than a volume resistance of said elastic layer and is smaller than the resistance of said surface layer.

12. A development apparatus as defined in claim 11, wherein said volume resistance of said elastic layer is $1.0\times10^9$ ohm·cm or less.

13. A development apparatus as defined in claim 11, wherein said entire volume resistance of said development roller is $1.0\times10^7$ ohm·cm or less.

14. A development apparatus as defined in claim 13, wherein said resistance of said surface layer is $1.0\times10^8$ ohms or less.

15. A development apparatus as defined in claim 11, wherein said surface layer has a thickness of 30 microns or less.

16. A development apparatus as defined in claim 11, wherein a toner deposition amount relative to a surface of a photosensitive member is saturated when a development bias has a difference of 150 volts or less from a surface potential of an image region in said photosensitive member.

17. A development apparatus, comprising:

a development roller comprising:

a core shaft;

first coating means for coating said core shaft; and second coating means for coating said first coating means, wherein a resistance of said second coating means is smaller than a resistance of said first coating means, and wherein an entire volume resistance of said development roller is smaller than a volume resistance of said first coating means and is smaller than the resistance of said second coating means.

18. A development apparatus as defined in claim 17, wherein said volume resistance of said second coating means is $1.0\times10^9$ ohm·cm or less.

19. A development apparatus as defined in claim 17, wherein said entire volume resistance of said development roller is $1.0\times10^7$ ohm·cm or less.

20. A development apparatus as defined in claim 19, wherein said resistance of said second coating means is 1.0 $n\times10^8$ ohms or less.

21. A development apparatus as defined in claim 17, wherein said second coating means has a thickness of 30 microns or less.

22. A development apparatus as defined in claim 17, wherein a toner deposition amount relative to a surface of a photosensitive member is saturated when a development bias has a difference of 150 volts or less from a surface potential of an image region in said photosensitive member.

23. An image forming apparatus, comprising:

a photosensitive member, and a development mechanism comprising a development roller, said development roller comprising:

a core shaft;

an elastic layer coating said core shaft; and a surface layer coating said elastic layer, wherein a resistance of said surface layer is smaller than a resistance of said elastic layer, and wherein an entire volume resistance of said development roller is smaller than a volume resistance of said elastic layer and is smaller than the resistance of said surface layer.

24. An image forming apparatus as defined in claim 23, wherein said volume resistance of said elastic layer is $1.0\times10^9$ ohm·cm or less.

25. An image forming apparatus as defined in claim 23, wherein said entire volume resistance of said development roller is $1.0\times10^7$ ohm·cm or less.

26. An image forming apparatus as defined in claim 25, wherein said resistance of said surface layer is $1.0\times10^8$ ohms or less.

27. An image forming apparatus as defined in claim 23, wherein said surface layer has a thickness of 30 microns or less.

28. An image forming apparatus as defined in claim 23, wherein a toner deposition amount relative to a surface of said photosensitive member is saturated when a development bias has a difference of 150 volts or less from a surface potential of an image region in said photosensitive member.

29. An image forming apparatus, comprising:

a photosensitive member, and a development mechanism comprising a development roller, said development roller comprising:

a core shaft;

first coating means for coating said core shaft; and second coating means for coating said first coating means, wherein a resistance of said second coating means is smaller than a resistance of said first coating means, and wherein an entire volume resistance of said development roller is smaller than a resistance of said first coating means and is smaller than the resistance of said second coating means.

30. An image forming apparatus as defined in claim 29, wherein said volume resistance of said second coating means is $1.0\times10^9$ ohm·cm or less.

31. An image forming apparatus as defined in claim 29, wherein said entire volume resistance of said development roller is $1.0\times10^7$ ohm·cm or less.

32. An image forming apparatus as defined in claim 31, wherein said resistance of said second coating means is $1.0\times10^8$ ohms or less.

33. An image forming apparatus as defined in claim 29, wherein said second coating means has a thickness of 30 microns or less.

34. An image forming apparatus as defined in claim 29, wherein a toner deposition amount relative to a surface of said photosensitive member is saturated when a development bias has a difference of 150 volts or less from a surface potential of an image region in said photosensitive member.

35. A method of image forming, comprising providing a rotary development roller that includes a core shaft coated with an elastic layer and a surface layer wrapped around the elastic layer, in parallel to a photosensitive member;

supplying toner onto a surface of said rotary development roller; and regulating said toner into a thin toner layer;

transferring said thin toner layer to said photosensitive member, wherein a resistance of said surface layer is smaller than a resistance of said elastic layer, and wherein an entire volume resistance of said development roller is smaller than a volume resistance of said elastic layer and is smaller than the resistance of said surface layer.

36. A method of image forming as defined in claim 35, wherein said volume resistance of said surface layer is $1.0\times10^9$ ohm·cm or less.

37. A method of image forming as defined in claim 35, wherein said entire volume resistance of said development roller is $1.0\times10^7$ ohm·cm or less.

38. A method of image forming as defined in claim 37, wherein said resistance of said surface layer is $1.0\times10^8$ ohms or less.

39. A method of image forming as defined in claim 35, wherein said surface layer has a thickness of 30 microns or less.

40. A method of image forming as defined in claim 35, wherein a toner deposition amount relative to a surface of said photosensitive member is saturated when a development bias has a difference of 150 volts or less from a surface potential of an image region in said photosensitive member.

* * * * *